US007786031B2

(12) United States Patent
Fang et al.

(10) Patent No.: US 7,786,031 B2
(45) Date of Patent: Aug. 31, 2010

(54) FLAME RESISTANT TEXTILE

(75) Inventors: Xinggao Fang, Duncan, SC (US); Nathan B Emery, Spartanburg, SC (US); James Travis Greer, Moore, SC (US)

(73) Assignee: Milliken & Company, Spartanburg, SC (US)

( * ) Notice: Subject to any disclaimer, the term of this patent is extended or adjusted under 35 U.S.C. 154(b) by 301 days.

(21) Appl. No.: 11/698,548

(22) Filed: Jan. 26, 2007

(65) Prior Publication Data

US 2008/0182470 A1 Jul. 31, 2008

(51) Int. Cl.
*B32B 5/02* (2006.01)

(52) U.S. Cl. ..... 442/136

(58) Field of Classification Search ..... 442/136; 264/103

See application file for complete search history.

(56) References Cited

U.S. PATENT DOCUMENTS

| | | | |
|---|---|---|---|
| 2,784,159 | A | 3/1957 | Fluck |
| 3,480,582 | A | 11/1969 | Brooks |
| 3,931,120 | A | 1/1976 | Shichijo et al. |
| 4,014,829 | A | 3/1977 | Baird et al. |
| 4,027,062 | A | 5/1977 | Engelbrecht et al. |
| 4,063,883 | A | 12/1977 | Hupfl et al. |
| 4,066,391 | A | 1/1978 | Weyker et al. |
| 4,167,603 | A | 9/1979 | Sistrunk |
| 4,618,469 | A | 10/1986 | Ogawa et al. |
| 4,657,809 | A | 4/1987 | Eskind |
| 4,732,789 | A | 3/1988 | Hauser |
| 4,748,705 | A | 6/1988 | Johnson |
| 4,842,611 | A | 6/1989 | Huffman |
| 4,902,300 | A | 2/1990 | Johnson et al. |
| 4,988,746 | A | 1/1991 | Tanaka et al. |
| 5,238,464 | A | 8/1993 | Johnson et al. |
| 5,503,915 | A | 4/1996 | Ichibori et al. |
| 5,503,916 | A | 4/1996 | Ichibori et al. |
| 5,506,042 | A | 4/1996 | Ichibori et al. |
| 5,888,914 | A | 3/1999 | Katz |
| 6,491,727 | B1 | 12/2002 | Rearick et al. |
| 6,524,653 | B1 | 2/2003 | Jones |
| 6,706,650 | B2 | 3/2004 | Gibson et al. |
| 6,787,228 | B2 | 9/2004 | Campbell et al. |
| 6,845,638 | B2 | 1/2005 | Ogata |
| 6,946,412 | B2 | 9/2005 | Campbell et al. |
| 2005/0025963 | A1 | 2/2005 | Zhu |
| 2005/0148256 | A1 | 7/2005 | Adachi |
| 2006/0059634 | A1 | 3/2006 | Tutterow |
| 2007/0190877 | A1 * | 8/2007 | Mio et al. ..... 442/136 |

FOREIGN PATENT DOCUMENTS

| | | | |
|---|---|---|---|
| EP | 1 619 278 | A | 1/2006 |
| WO | WO9012134 | | 10/1990 |
| WO | WO 2006/008900 | A | 1/2006 |
| WO | WO 2006/118009 | A | 11/2006 |

OTHER PUBLICATIONS

International Search Report dated May 9, 2008; International Application No.: PCT/US2008/000557.

* cited by examiner

*Primary Examiner*—Arti Singh-Pandey

(57) ABSTRACT

Flame resistant fabrics of suitable strength and comfort level for use in apparel applications. The fabrics incorporate yarns utilizing specific blends of (A) halogen containing fibers, (B) silica embedded cellulosic fibers and (C) strength imparting synthetic fibers.

16 Claims, 2 Drawing Sheets

FIG. —1—

FLAME RESISTANT TEXTILE

TECHNICAL FIELD

The present invention relates generally to yarns of flame retardant character and to textile structures incorporating such yarns. More specifically, the invention relates to yarns and to a textile material formed from a plurality of such yarns wherein at least a portion of the yarns include a combination of (i) halogen containing fibers, (ii) silica embedded cellulosic fibers and (iii) strength imparting synthetic fibers. The fibers are present at levels within defined ratios providing strength and flame resistance. All patent documents referenced in this application are hereby incorporated by reference as if fully set forth herein.

BACKGROUND

It is well known to treat yarns and/or fabrics with chemical compositions to improve flame resistance. By way of example, in one known process, ammonia and tetrakis hydroxymethyl phosphate salts are used. However, such chemical treatments may render undesired odors and/or degrade the physical strength of the fabric.

It is also known to use inherently flame resistant fibers such as aramid fiber and the like. While such fibers may provide good flame resistance, they may also be difficult to dye and provide lower levels of physical comfort for the user.

Flame resistant cellulosic fibers are also known. However, such fibers are typically characterized by relatively low mechanical strength levels so as to have a disadvantage for long term use. Moreover, the high absorption capacity of the fibers results in retaining moisture when the user perspires.

Halogen containing fibers such as modacrylics and PVC are known to provide good flame resistance, but they tend to have relatively poor heat resistance and do not form a stable char for user protection.

Flame resistant fabrics with blends containing modacrylics in combination with cellulosic or synthetic fibers are also known. Relatively large amounts of metal oxides may be added to the modacrylic fibers to promote flame resistance. Exemplary references include U.S. Pat. Nos. 5,503,915; 5,503,916; 5,506,042; and U.S. application 20050148256 all of which are incorporated by reference in their entirety.

Flame resistant fabrics with yarns containing blends of modacrylic fiber and polysilic acid embedded rayon (such as VISIL®) is known for use in bedding. However, fabric physical strength is such that the production of apparel may be problematic due to degradation caused by abrasion and frequent washing.

Finally, it is known to use high loft non-woven fabrics containing blends of modacrylic fiber, polysilic acid embedded rayon, low melting point polyester and PET as a flame barrier in mattresses. However, forming fabrics from these same blends does not provide sufficient flame resistance for apparel use.

SUMMARY

The present invention provides advantages and/or alternatives over the prior art by providing flame resistant fabrics of suitable strength and comfort level for use in apparel applications. The fabrics incorporate yarns utilizing specific blends of (A) halogen containing fibers, (B) silica embedded cellulosic fibers and (C) strength imparting synthetic fibers.

According to one potentially preferred non-limiting practice, a woven or knit fabric is provided incorporating spun yarns wherein the yarns are formed from a blend of (A) about 55% to about 70% halogen containing fibers such as modacrylic and/or PVC; (B) about 10% to about 25% of VISIL® or other silica embedded cellulosic fiber with an aluminum-based coating such as alumina silicate; and (C) about 10% to about 35% of synthetic fiber such as PET and/or polyamide. The fabric is characterized by substantial flame resistance in combination with strength and abrasion resistance that rate it for apparel use.

BRIEF DESCRIPTION OF THE DRAWINGS

The present invention will now be described by way of example only, with reference to the accompanying drawings which constitute a part of the specification herein and in which.

While the invention may be described in connection with certain illustrated and potentially preferred embodiments, procedures and practices, it is to be understood that in no event is the invention to be limited to such illustrated and described embodiments, procedures and practices. On the contrary, it is intended that the present invention shall extend to all alternatives and modifications as may embrace the principles of this invention within the true spirit and scope thereof.

DETAILED DESCRIPTION

Figure 1:
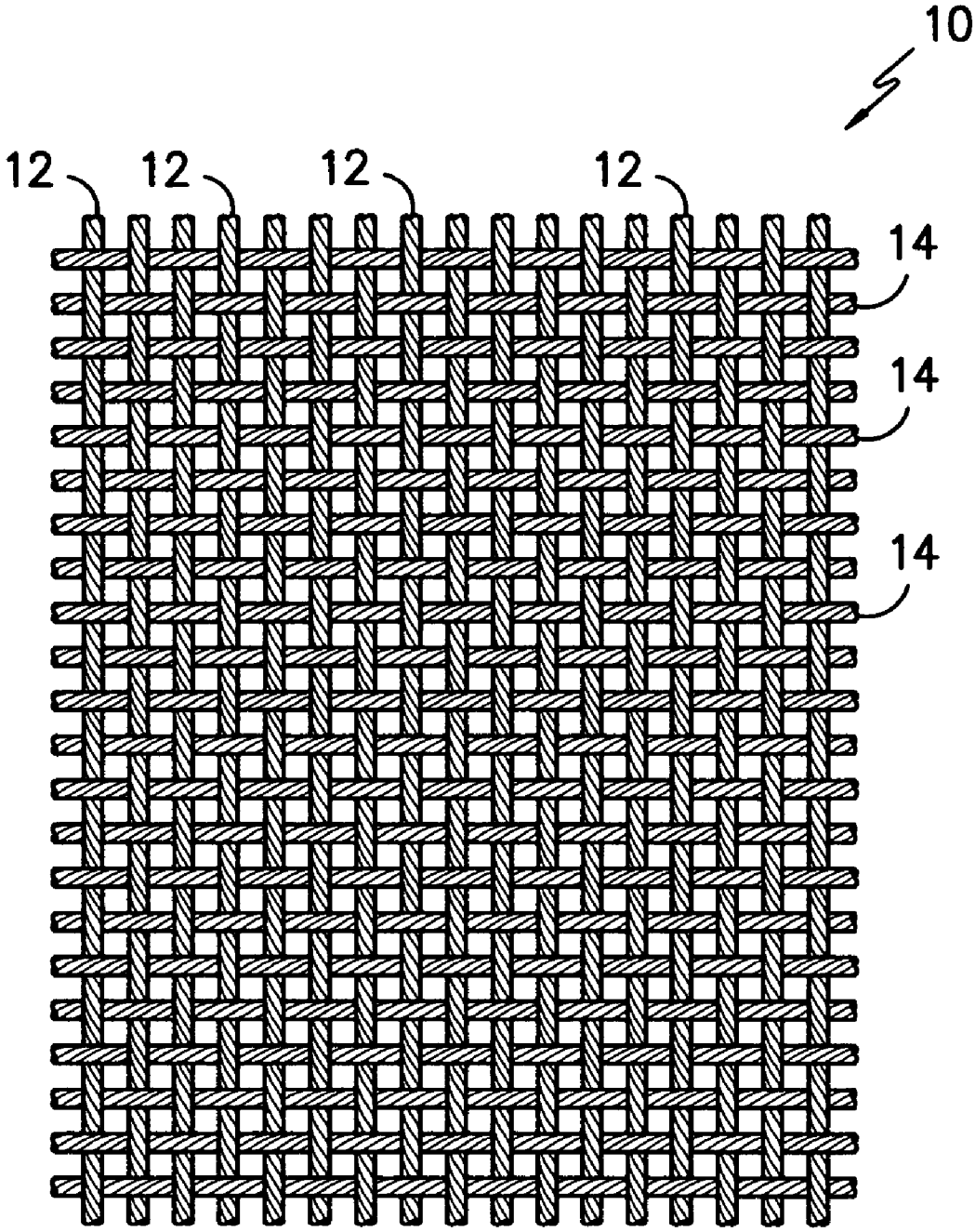
FIG. 1 is an elevation plan view of a woven fabric formed from yarns.
Figure 2:
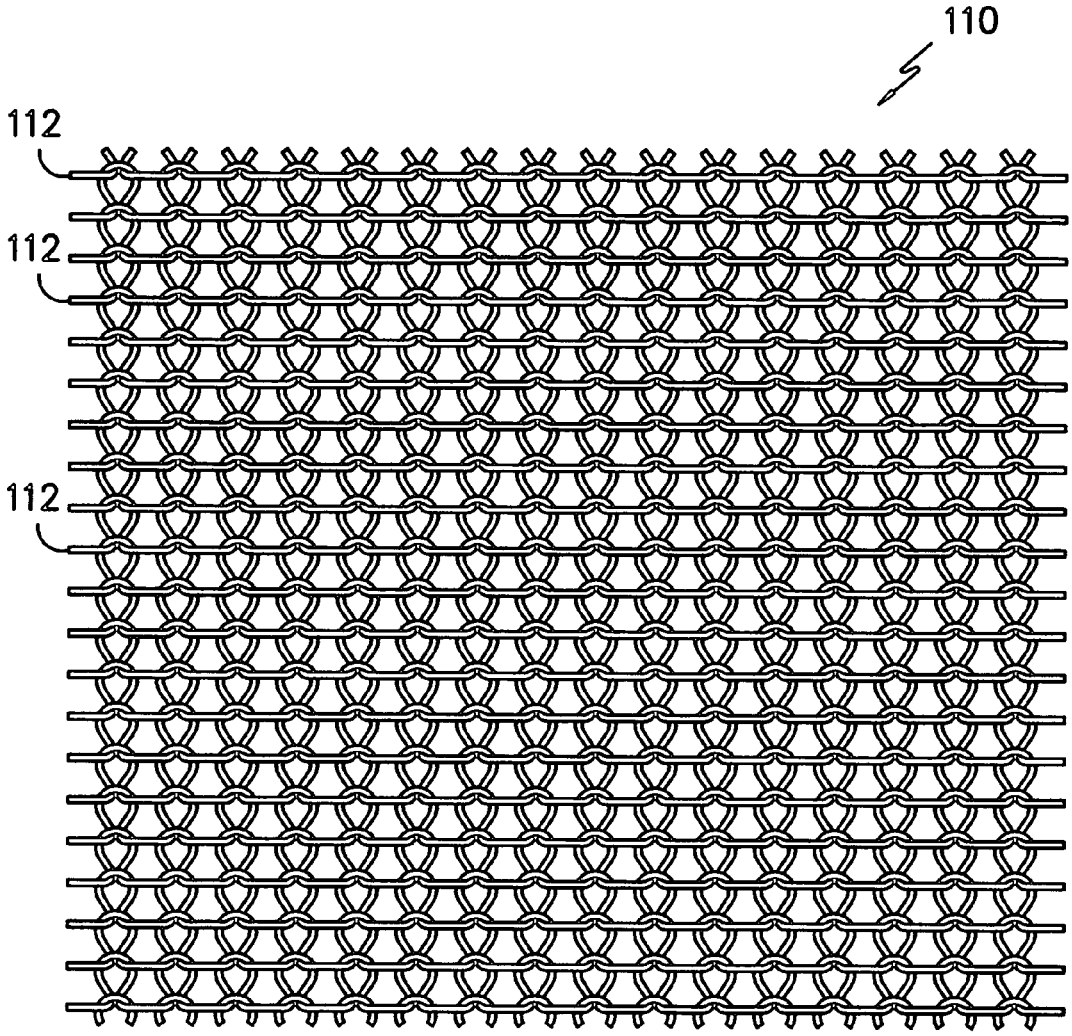
FIG. 2 is an elevation plan view of a knit fabric formed from yarns.

FIG. 1 shows an exemplary woven fabric 10 incorporating an arrangement of warp yarns 12 extending in a first direction and weft or fill yarns 14 extending in transverse relation to the warp yarns. Of course, it is to be understood that the illustrated spacing between the yarns is exaggerated for ease of reference and that closer spacing between the yarns is generally preferred. Likewise, although a plain weave structure is illustrated, it is contemplated that virtually any other weaving construction may likewise be utilized including, but not limited to, twill weaves, basket weaves, jacquard weaves and other constructions as will be known to those of skill in the art. FIG. 2 shows an exemplary knit fabric 110 incorporating yarns 112 in an interlocking arrangement of loops in a manner as will be well known to those of skill in the art. Of course, it is to be understood that the illustrated spacing between the yarns is exaggerated for ease of reference and that closer spacing between the yarns is generally preferred. Likewise, although a simple weft knit construction is illustrated, it is contemplated that virtually any other knit construction may be utilized including, but not limited to, warp knits including raschel knits, tricot knits and the like, double knits, and structures using more complex insertion techniques such as weft insertion fabrics and the like. Single or multi-bar constructions may be utilized. It is also contemplated that any number of other fabric formation techniques including stitch bonding and the like may also be utilized if desired.

Regardless of the fabric construction, it is contemplated that at least a substantial percentage of the formation yarns are flame retardant composite yarns incorporating (A) about 55% to about 70% halogen containing fibers having about 0 to not more than about 0.5% Sb; (B) about 10% to about 25% of a polysilic acid embedded rayon fiber with an aluminum-based coating; and (C) about 10% to about 35% of synthetic fiber wherein all percentages are by weight. The flame retardant composite yarns are preferably spun yarns such as ring spun yarns and the like wherein discrete staple fibers from each of the categories as set forth above are bound together in a cohesive structure by twisting. The flame retardant composite yarns may be single ply or multi-ply as desired.

The halogen containing fiber preferably contains little if any antimony, magnesium, aluminum or other oxide forming inorganic metal additives. In this regard, the halogen containing fiber preferably contains less than about 0.5% oxide forming inorganic metal additives, more preferably less than about 0.2% oxide forming inorganic metal additives and most preferably is substantially free from oxide forming inorganic metal additives. Accordingly, the flame retardancy of the yarn is not dependent upon the use of Sb or other oxide forming inorganic metal additives in the halogen-containing fiber constituent. If desired, it is contemplated that Sb optionally may be included in the non-halogenated fiber constituents.

By way of example only, and not limitation, a contemplated halogen containing fiber for use in the composite yarn is a so called "modacrylic" fiber made from resins that are copolymers of acrylonitrile and other materials. Such fibers are characterized by having about 35% to about 85% acrylonitrile units $(—CH_2CH[CN]—)_x$. By way of example only, and not limitation, exemplary modacrylic fibers include copolymers of acrylonitrile in combination with one or more halogen-containing vinyl monomers such as acrylonitrile-vinylidene chloride, acrylonitrile-vinyl chloride, acrylonitrile-vinyl chloride-vinylidene chloride, acrylonitrile-vinyl bromide, acrylonitrile-vinylidene chloride-vinyl bromide, and acrylonitrile-vinyl chloride-vinyl bromide copolymers. One potentially desirable modacrylic fiber is believed to be sold by Fushun Huifu Fire Resistant Fiber Corporation, Ltd. having a place of business in Fushun, China.

The halogen containing fiber for use in the composite yarn is not necessarily limited to modacrylic fibers. Other exemplary fibers may include, for instance, fibers formed substantially from homopolymers or copolymers of halogen containing vinyl monomers such as vinyl chloride, vinylidene chloride, vinyl bromide, and vinylidene bromide. The halogen containing fibers for use in the composite yarn may also include copolymers of at least one halogen-containing vinyl monomer such as vinyl chloride, vinylidene chloride, vinyl bromide, and vinylidene bromide, acrylonitrile, and a vinyl compound copolymerizable with the halogen-containing vinyl monomer and acrylonitrile. The halogen containing fibers for use in the composite yarn may also include an acrylonitrile homopolymer to which a halogen-containing compound such as chloroparaffine, decobromodiphenyl ether, and brominated bisphenol A and derivatives is added. Still other halogen containing fibers for use in the composite yarn include halogen containing polyesters including polyester fibers obtained by impregnating with a halogen-containing compound such as hexabromocyclododecane and the like. Each of the contemplated polymers may be utilized alone or in admixture. Non-brominated polymers may be particularly preferred.

The polysilic acid embedded rayon fiber is preferably a material such as VISIL® fiber or the like manufactured by Sateri International of Finland. Such materials preferably exhibit silicic acid levels of approximately 30%. The polysilic acid embedded rayon fiber also preferably includes an alumina silicate coating which aids in the prevention of leaching of the mineral additions during washing.

The third fiber component is preferably a synthetic polymer fiber such as polyester such as PET, polyamide such as Nylon 6 or Nylon 6,6 and the like. Such materials are believed to promote strength in the fabric and to provide a degree of enhanced char stability as they undergo melt fusion during combustion.

As noted previously, the flame retardant composite yarns are preferably spun yarns. Each of the fiber constituents is preferably characterized by average linear density levels in the range of about 1.7 to about 12 dtex. However high or lower levels may be used if desired. The fiber constituents are blended in the desired ratio and then subjected to spinning to form the yarn followed by fabric formation.

The fabrics formed from the flame retardant composite yarns may be formed substantially entirely from the flame retardant composite yarns. Alternatively the fabrics may be formed only partially from such retardant composite yarns. Likewise, it is contemplated that flame retardant composite yarns incorporating different ratios of the identified fiber constituents may be used in different portions of the fabric. By way of example only, and not limitation, it is contemplated that yarns having a first composition may be used as the warp yarns 12 in a woven fabric while yarns having a second different composition may be used as the weft yarns 14.

Exemplary features will hereinafter be described through reference to the following non-limiting examples. For purposes of all examples, reference to fabric in the "as woven" state refers to fabric that has been finished and dyed but not otherwise treated.

Examples 1-6

Four ring spun single ply yarns were formed incorporating various percentages of a modacrylic fiber, VISIL® fiber and PET fiber. The modacrylic fiber was a commercial product (2.2 dtex×38 mm) purchased from Fushun Huifu Fire Resistant Fiber Corporation, Ltd. The VISIL® had an average linear density of 1.7 dtex and length of 40 mm. The PET had an average linear density of 1.2 denier per filament and length of 38 mm. The yarn compositions and constructions are set forth in Table 1.

TABLE 1

(YARN SAMPLES)

| YARN | % PET | % VISIL ® | % Modacrylic | STRUCTURE |
|---|---|---|---|---|
| A | 45 | 10 | 45 | 16/1 |
| B | 7.5 | 22.5 | 70 | 16/1 |
| C | 25 | 10 | 65 | 16/1 |
| D | 12.5 | 22.5 | 65 | 16/1 |

Various combinations of the yarns as outlined above were formed into fabrics 1-6 as set forth below in Table 2. Each of the fabrics had a 3×1 LH twill weave construction with 104 ends per inch and 58 picks per inch and a weight of 7 ounces per square yard.

TABLE 2

(FABRIC SAMPLE COMPOSITION)
(PERCENTAGES BASED ON TOTAL FABRIC WEIGHT)

| FABRIC | WARP | FILL | % PET | % VISIL ® | % Modacrylic |
|---|---|---|---|---|---|
| 1 | A | B | 30 | 15 | 55 |
| 2 | A | D | 32 | 15 | 53 |
| 3 | A | A | 45 | 10 | 45 |
| 4 | C | D | 20 | 15 | 65 |
| 5 | C | B | 18 | 15 | 67 |
| 6 | C | C | 25 | 10 | 65 |

TABLE 2-continued (FABRIC SAMPLE COMPOSITION)
(PERCENTAGES BASED ON TOTAL FABRIC WEIGHT)

| FABRIC | WARP | FILL | % PET | % VISIL ® | % Modacrylic |
|---|---|---|---|---|---|

Each of the fabrics from Table 2 was subjected to an open flame burn test pursuant to NFPA test method 701 (1989) measuring char length, after flame glow and drip. These tests were conducted in both an "as woven" state and after 50 industrial wash cycles. The burn test results are set forth in Table 3 below.

TABLE 3

(FABRIC SAMPLE BURN TESTING)

| Fabric | Char Length (in) (as woven) | Char Length (in) (50 wash cycles) | After Flame Glow (sec) (as woven) | After Flame Glow (sec) (50 wash cycles) |
|---|---|---|---|---|
| 1 | 4.17 | 4.23 | 0 | 0 |
| 2 | 4.6 | 4.4 | 9.2 | 0 |
| 3 | 6.47 | 5.63 | 27 | 12.9 |
| 4 | 4.12 | 3.55 | 0 | 0 |
| 5 | 3.95 | 3.33 | 0 | 0 |
| 6 | 4.08 | 3.66 | 0 | 0 |

All samples exhibited no drip in both the "as woven" and washed condition.

Each of the fabrics from Table 2 was subjected to a flex abrasion test in both the warp and the fill directions pursuant to test method ASTM D-3885. These tests were conducted in both an "as woven" state and after 50 industrial wash cycles. The flex abrasion test results are set forth in Table 4 below. The reported values represent the number of cycles required to produce fabric break.

TABLE 4

(FABRIC SAMPLE FLEX ABRASION LEVELS)

| Fabric | Warp (as woven) | Warp (50 wash cycles) | Fill (as woven) | Fill (50 wash cycles) |
|---|---|---|---|---|
| 1 | 3315 | 1270 | 2919 | 3329 |
| 2 | 3724 | 2200 | 1220 | 2445 |
| 3 | 3832 | 2671 | 1319 | 2028 |
| 4 | 2174 | 2021 | 2918 | 2147 |
| 5 | 3409 | 2293 | 2248 | 2495 |
| 6 | 3422 | 1880 | 2546 | 2443 |

Each of the fabrics from Table 2 was subjected to grab tensile testing under ASTM standard D5034 in both the warp and the fill directions. These tests were conducted in both an "as woven" state and after 50 industrial wash cycles. The tensile test results are set forth in Table 5 below. The results are reported in units of pounds force.

TABLE 5

(FABRIC SAMPLE TENSILE TEST RESULTS)

| Fabric | Warp (as woven) | Warp (50 wash cycles) | Fill (as woven) | Fill (50 wash cycles) |
|---|---|---|---|---|
| 1 | 197 | 176 | 73 | 82 |
| 2 | 202 | 175 | 95 | 84 |
| 3 | 189 | 179 | 92 | 100 |

TABLE 5-continued (FABRIC SAMPLE TENSILE TEST RESULTS)

| Fabric | Warp (as woven) | Warp (50 wash cycles) | Fill (as woven) | Fill (50 wash cycles) |
|---|---|---|---|---|
| 4 | 160 | 165 | 105 | 80 |
| 5 | 186 | 167 | 100 | 84 |
| 6 | 178 | 162 | 109 | 94 |

Each of the fabrics from Table 2 was subjected to a tongue tear testing in both the warp and the fill directions pursuant to ASTM D2261. These tests were conducted in both an "as woven" state and after 50 industrial wash cycles. The tongue tear test results are set forth in Table 6 below. The results are reported in units of pounds force.

TABLE 6

(FABRIC SAMPLE TONGUE TEAR TEST RESULTS)

| Fabric | Warp (as woven) | Warp (50 wash cycles) | Fill (as woven) | Fill (50 wash cycles) |
|---|---|---|---|---|
| 1 | 6.6 | 6.1 | 3.5 | 3 |
| 2 | 8 | 6 | 3.8 | 3.2 |
| 3 | 6.7 | 6.6 | 5.5 | 5.2 |
| 4 | 5.5 | 4.9 | 3.4 | 2.9 |
| 5 | 5.8 | 4.8 | 3.1 | 2.6 |
| 6 | 5.8 | 5.1 | 4.2 | 3.7 |

Comparative Example 7

A flame resistant ring spun single ply cotton yarn marketed under the trade designation INDURA® from Westex Company? was formed into 3×1 LH twill weave fabric with 95 ends per inch and 50 picks per inch. The fabric had a weight of 7 ounces per square yard. The warp yarn had a cotton count structure of 20/1 and the fill yarn has a structure of 13/1. The fabric was tested for the various parameters as outlined in table 3-6 above.

The fabric was subjected to an open flame burn test pursuant to NFPA test method 701 (1989) measuring char length, after flame glow and drip. The results are reported in Table 7 below.

TABLE 7

(100% COTTON FABRIC SAMPLE BURN TESTING)

| Fabric | Char Length (in) (as woven) | Char Length (in) (50 wash cycles) | After Flame Glow (sec) (as woven) | After Flame Glow (sec) (50 wash cycles) |
|---|---|---|---|---|
| 100% cotton | 3.8 | — | 0 | — |

The 100% cotton fabric was subjected to a flex abrasion test in both the warp and the fill directions pursuant to test method ASTM D-3885. These tests were conducted in both an "as woven" state and after 50 industrial wash cycles. The flex abrasion test results are set forth in Table 8 below.

TABLE 8

(FABRIC SAMPLE FLEX ABRASION LEVELS)

| Fabric | Warp (as woven) | Warp (50 wash cycles) | Fill (as woven) | Fill (50 wash cycles) |
|---|---|---|---|---|
| 100% cotton | 1039 | 409 | 893 | 227 |

The 100% cotton fabric was subjected to tensile testing in both the warp and the fill directions. These tests were conducted in both an "as woven" state and after 50 industrial wash cycles. The tensile test results are set forth in Table 9 below.

TABLE 9

(FABRIC SAMPLE TENSILE TEST RESULTS)

| Fabric | Warp (as woven) | Warp (50 wash cycles) | Fill (as woven) | Fill (50 wash cycles) |
|---|---|---|---|---|
| 100% cotton | 136 | 123 | 67 | 74 |

The 100% cotton fabric was subjected to tongue tear test in both the warp and the fill directions. These tests were conducted in both an "as woven" state and after 50 industrial wash cycles. The tensile test results are set forth in Table 10 below.

TABLE 10

(FABRIC SAMPLE TONGUE TEAR TEST RESULTS)

| Fabric | Warp (as woven) | Warp (50 wash cycles) | Fill (as woven) | Fill (50 wash cycles) |
|---|---|---|---|---|
| 100% cotton | 9.8 | 4 | 8.9 | 4.1 |

Comparative Example 8

A flame resistant ring spun single ply cotton/nylon yarn incorporating 88% INDURA flame retardant cotton and 12 percent nylon was formed into a 3×1 LH twill weave fabric with 95 ends per inch and 50 picks per inch. The fabric had a weight of 7 ounces per square yard. The warp yarn had a cotton count structure of 20/1 and the fill yarn has a structure of 13/1. The fabric was tested for the various parameters as outlined in table 3-6 above.

The cotton/nylon fabric was subjected to an open flame burn test pursuant to NFPA test method 701 (1989) measuring char length, after flame glow and drip. The results are reported in Table 11 below.

TABLE 11

(COTTON/NYLON FABRIC SAMPLE BURN TESTING)

| Fabric | Char Length (in) (as woven) | Char Length (in) (50 wash cycles) | After Flame Glow (sec) (as woven) | After Flame Glow (sec) (50 wash cycles) |
|---|---|---|---|---|
| Cotton/ Nylon | 3.2 | — | 0 | — |

The cotton/nylon fabric was subjected to a flex abrasion test in both the warp and the fill directions pursuant to test method ASTM D-3885. These tests were conducted in both an "as woven" state and after 50 industrial wash cycles. The flex abrasion test results are set forth in Table 12 below.

TABLE 12

(FABRIC SAMPLE FLEX ABRASION LEVELS)

| Fabric | Warp (as woven) | Warp (50 wash cycles) | Fill (as woven) | Fill (50 wash cycles) |
|---|---|---|---|---|
| Cotton/ Nylon | 12120 | 4112 | 1019 | 1124 |

The cotton/nylon fabric was subjected to tensile testing in both the warp and the fill directions. These tests were conducted in both an "as woven" state and after 50 industrial wash cycles. The tensile test results are set forth in Table 13 below.

TABLE 13

(FABRIC SAMPLE TENSILE TEST RESULTS)

| Fabric | Warp (as woven) | Warp (50 wash cycles) | Fill (as woven) | Fill (50 wash cycles) |
|---|---|---|---|---|
| Cotton/ Nylon | 107 | 111 | 70 | 81 |

The cotton/nylon fabric was subjected to tongue tear testing in both the warp and the fill directions. These tests were conducted in both an "as woven" state and after 50 industrial wash cycles. The tensile test results are set forth in Table 14 below.

TABLE 14

(FABRIC SAMPLE TONGUE TEAR TEST RESULTS)

| Fabric | Warp (as woven) | Warp (50 wash cycles) | Fill (as woven) | Fill (50 wash cycles) |
|---|---|---|---|---|
| Cotton/ Nylon | 6.1 | 4.6 | 8.4 | 6.6 |

As can be seen from a comparison of the above data, fabrics formed from the three component composite yarn exhibit excellent flame retardancy based on char length in combination with improved strength and with relatively high flex abrasion values.

It is to be understood that the detailed description as well as the specific examples presented herein are intended to be illustrative and explanatory only. Thus, while the invention has been described in relation to potentially preferred embodiments, constructions, and procedures, the invention is in no event to be limited thereto. Rather, it is contemplated that modifications and variations embodying the principles of the invention will no doubt occur to those of ordinary skill in the art. It is therefore contemplated and intended that the present invention shall extend to all such modifications and variations as may incorporate the broad aspects of the invention within the true spirit and scope thereof.

That which is claimed is:

1. A fabric comprising a plurality of flame retardant composite yarns, wherein the flame retardant composite yarns consist essentially of a blend of (A) about 55% to about 70% by weight halogen containing fibers having about 0 to not more than about 0.5% antimony; (B) about 10% to about 25% by weight of polysilic acid embedded rayon fibers with an alumina silicate coating; and (C) about 10% to about 35% of heat fusible synthetic fiber selected from the group consisting of polyester, polypropylene, nylon and combinations thereof.

2. The invention as recited in claim 1, wherein the halogen containing fibers are substantially free of bromine.

3. The invention as recited in claim 2, wherein the halogen containing fibers are substantially free of antimony.

4. The invention as recited in claim 3, wherein the flame retardant composite yarns are spun yarns.

5. The invention as recited in claim 4, wherein the fabric is a woven fabric comprising a first plurality of the flame retardant composite yarns running in a warp direction and a second plurality of the flame retardant composite yarns running in a fill direction transverse to the warp direction.

6. The invention as recited in claim 5, wherein the flame retardant composite yarns running in the warp direction comprise substantially the same blend of fibers as the flame retardant composite yarns running in the fill direction.

7. The invention as recited in claim 5, wherein the flame retardant composite yarns running in the warp direction comprise a different blend of fibers than the flame retardant composite yarns running in the fill direction.

8. The invention as recited in claim 4, wherein the fabric is a knit fabric.

9. A fabric comprising a plurality of flame retardant composite yarns, wherein the flame retardant composite yarns consist essentially of a blend of (A) about 55% to about 70% by weight of non-brominated halogen containing fibers having about 0 to not more than about 0.5% antimony wherein the halogen containing fibers are selected from the group consisting of modacrylic fibers, polyvinyl chloride fibers and combinations thereof; (B) about 10% to about 25% by weight of polysilic acid embedded rayon fibers with an alumina silicate coating; and (C) about 10% to about 35% of heat fusible synthetic fiber selected from the group consisting of polyester, polypropylene, nylon and combinations thereof.

10. The invention as recited in claim 9, wherein the halogen containing fibers are substantially free of antimony.

11. The invention as recited in claim 9, wherein the flame retardant composite yarns are spun yarns.

12. The invention as recited in claim 11, wherein the fabric is a woven fabric comprising a first plurality of the flame retardant composite yarns running in a warp direction and a second plurality of the flame retardant composite yarns running in a fill direction transverse to the warp direction.

13. The invention as recited in claim 12, wherein the flame retardant composite yarns running in the warp direction comprise substantially the same blend of fibers as the flame retardant composite yarns running in the fill direction.

14. The invention as recited in claim 12, wherein the flame retardant composite yarns running in the warp direction comprise a different blend of fibers than the flame retardant composite yarns running in the fill direction.

15. The invention as recited in claim 4, wherein the fabric is a knit fabric.

16. A method of forming a flame retardant fabric comprising the steps of:

providing a fiber blend consisting essentially of (A) about 55% to about 70% by weight of non-brominated halogen containing fibers having about 0 to not more than about 0.5% antimony wherein the halogen containing fibers are selected from the group consisting of modacrylic fibers, polyvinyl chloride fibers and combinations thereof; (B) about 10% to about 25% by weight of polysilic acid embedded rayon fibers with an alumina silicate coating; and (C) about 10% to about 35% of heat fusible synthetic fiber selected from the group consisting of polyester, polypropylene, nylon and combinations thereof;

spinning the fiber blend into a plurality of yarns; and knitting or weaving the yarns into a fabric structure.

* * * * *